US006827523B2

(12) United States Patent
Medendorp

(10) Patent No.: US 6,827,523 B2
(45) Date of Patent: Dec. 7, 2004

(54) CONCRETE FLOAT ADJUSTING DEVICE

(75) Inventor: David J. Medendorp, Racine, WI (US)

(73) Assignee: The Fall River Group, Inc., Fall River, WI (US)

( * ) Notice: Subject to any disclaimer, the term of this patent is extended or adjusted under 35 U.S.C. 154(b) by 0 days.

(21) Appl. No.: 10/838,273

(22) Filed: May 4, 2004

(65) Prior Publication Data

US 2004/0223810 A1 Nov. 11, 2004

Related U.S. Application Data

(60) Provisional application No. 60/468,776, filed on May 8, 2003.

(51) Int. Cl.[7] ..... E01C 19/22

(52) U.S. Cl. ..... 404/97; 404/118; 16/110.1; 403/44; 15/143.1

(58) Field of Search ..... 15/143.1, 144.1, 15/235.4, 235.8; 404/97, 118; 16/110.1, 431; 403/44, 119, 164, 230, 341; 277/345, 500

(56) References Cited

U.S. PATENT DOCUMENTS

| | | | | | |
|---|---|---|---|---|---|
| 2,999,261 | A | * | 9/1961 | Lapham | 15/235.8 |
| 3,082,460 | A | | 3/1963 | Haivala | |
| 3,090,066 | A | * | 5/1963 | Ferrell, Jr. et al. | 15/235.8 |
| 3,146,481 | A | | 9/1964 | Chiurchiarelli | |
| 3,798,701 | A | | 3/1974 | Irwin et al. | |
| 4,520,527 | A | | 6/1985 | Maggio et al. | |
| 4,702,641 | A | | 10/1987 | Naser et al. | |
| 4,722,637 | A | | 2/1988 | Glesmann | |
| 4,752,154 | A | | 6/1988 | Valentine | |
| 4,856,932 | A | | 8/1989 | Kraft | |
| 4,892,437 | A | | 1/1990 | Kraft | |
| 5,115,536 | A | | 5/1992 | Jarvis | |
| D343,998 | S | * | 2/1994 | Griggs | D8/45 |
| 5,687,448 | A | | 11/1997 | Dye, Jr. | |
| 6,227,750 | B1 | | 5/2001 | Maggio et al. | |

* cited by examiner

*Primary Examiner*—Gary S. Hartmann
(74) *Attorney, Agent, or Firm*—Andrus, Sceales, Starke & Sawall, LLP

(57) ABSTRACT

A concrete float adjusting device is disclosed which enables a user to adjust the angle of a float coupled to the adjusting device so that the float does not gouge into the unset surface of freshly poured concrete. The adjusting device includes a base coupled to the float, and a shaft rotatable in a pivot bearing pivotally coupled to the base. The shaft is formed with a pair of spiral slots which define a path of travel for a pair of upper pivot shafts projecting into the slots and guiding a protective sleeve and an integral follower sleeve together for sliding movement on the shaft. A pair of shiftable link arms extend between the upper pivot shafts and a pair of lower pivot shafts pivotally coupling the base to the link arms. Rotation of the shaft causes linear sliding movement of the protective sleeve and follower sleeve along the shaft. This motion is transmitted by the shifting link arms to the base so as to change the angle of the float relative to the shaft.

10 Claims, 7 Drawing Sheets

CONCRETE FLOAT ADJUSTING DEVICE

CROSS REFERENCE TO RELATED APPLICATION

This application relates to and claims priority from U.S. Provisional Application Ser. No. 60/468,776 filed May 8, 2003.

FIELD OF THE INVENTION

This invention relates to a concrete finishing tool which allows a user to adjust the angle of a float as it is being pulled towards or pushed away from the user.

BACKGROUND OF THE INVENTION

In providing a smooth finish to large slabs of concrete, a tool called a float is used to induce the fine particles of sand and concrete to come to the surface of the slab for subsequent finish troweling. Since the concrete is still unset, it is undesirable to walk over its surface, because this will disturb the natural settling and separation of the particles. It is desired that the fine particles come to the surface and that the larger particles distribute themselves through the lower regions of the concrete. This segregation of particles is facilitated by the use of the float which the user drags back and forth over the surface of the slab.

Long handles are used so that a large surface area may be reached from a single point. Employing long handles presents a problem in using the float. If the edge of the float is slanted downward in the direction of motion, the float will cut into the concrete rather than smoothing its surface. Since the float is drawn towards the user and then pushed away, it is necessary to change the angle of incidence by either lowering the long handle when pushing the float or raising it when pulling the float. This works adequately when the length of the handle is, for example, less than about 12 feet. If, for example, a very long handle 20 feet in length is used, the height required to lift the one end of the handle to prevent gouging the concrete surface will, in many instances, be out of reach of the user or in the range where he can no longer exert sufficient force to pull the float. Similarly, when pushing the float away, to correct the tilt edge of the float, the handle may have to be lower than the surface of the concrete being prepared.

SUMMARY OF THE INVENTION

The invention relates to an improved concrete float adjusting de vice which provides a reliable and easy way to change the tilting angle of incidence of the float by the user's simple rotation of the handle at some remote distance from the float. The tilt control mechanism is characterized by a dual spirally slotted shaft which, because of a surrounding, scaled protective sleeve, can be kept free of concrete and abrasive materials which damage bearing surfaces during use and greatly reduce the life of the mechanism. The use of the protective sleeve around the shaft further cuts down on the cleanup time required and improves overall efficiency at the finishing worksite.

The concrete float adjusting device includes a base having a pail of spaced apart, upstanding portions and a planar support plate which is attached to a concrete float. An elongated rotatable shaft has a reduced diameter or narrow front end portion surrounded by support bearings, a handle-receiving rear end portion, and an intermediate portion formed with a pair of spiral slots. A pivot bearing has a lower end pivotally coupled to the base, and an upper end encircling the reduced diameter, bearing supported front end portion of the shaft such that the shaft is rotatably received in the upper end of the pivot bearing. A protective sleeve surrounds the intermediate portion of the shaft for slidable movement thereon and protectively covers the spiral slots to prevent accumulation of material therein. The protective sleeve is provided with a pair of circular seals at opposite ends thereof which are engageable with the shaft. A follower sleeve extends completely around the intermediate portion of the shaft and the protective sleeve. The follower sleeve is integrally coupled to the protective sleeve such that the follower sleeve and the protective sleeve are slideable as a unit along the intermediate portion of the shaft. A pair of upper pivot shafts having outer ends is located on opposite sides of the follower sleeve. The upper pivot shafts project through the follower sleeve and the protective sleeve and have inner ends engaged in the spiral slots. A pair of lower pivot shafts has outer ends located on opposite sides of the upstanding portions of the base, and inner ends projecting into upstanding portions of the base. A pair of shiftable link arms is provided, each having an upper end pivotally connected to one of the upper pivot shafts and a lower end pivotally connected to one of the lower pivot shafts. Rotation of the shaft, such as by a handle connected thereto, causes the follower sleeve and protective sleeve to move linearly along the shaft as the inner ends of the upper pivot shafts follow a path of the spiral slots. This motion results in transmitting movement of the follower sleeve and protective sleeve via the shifting of the link arms to the base which is pivotally coupled to the pivot bearing so as to change the angular relationship between the float and the shaft.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
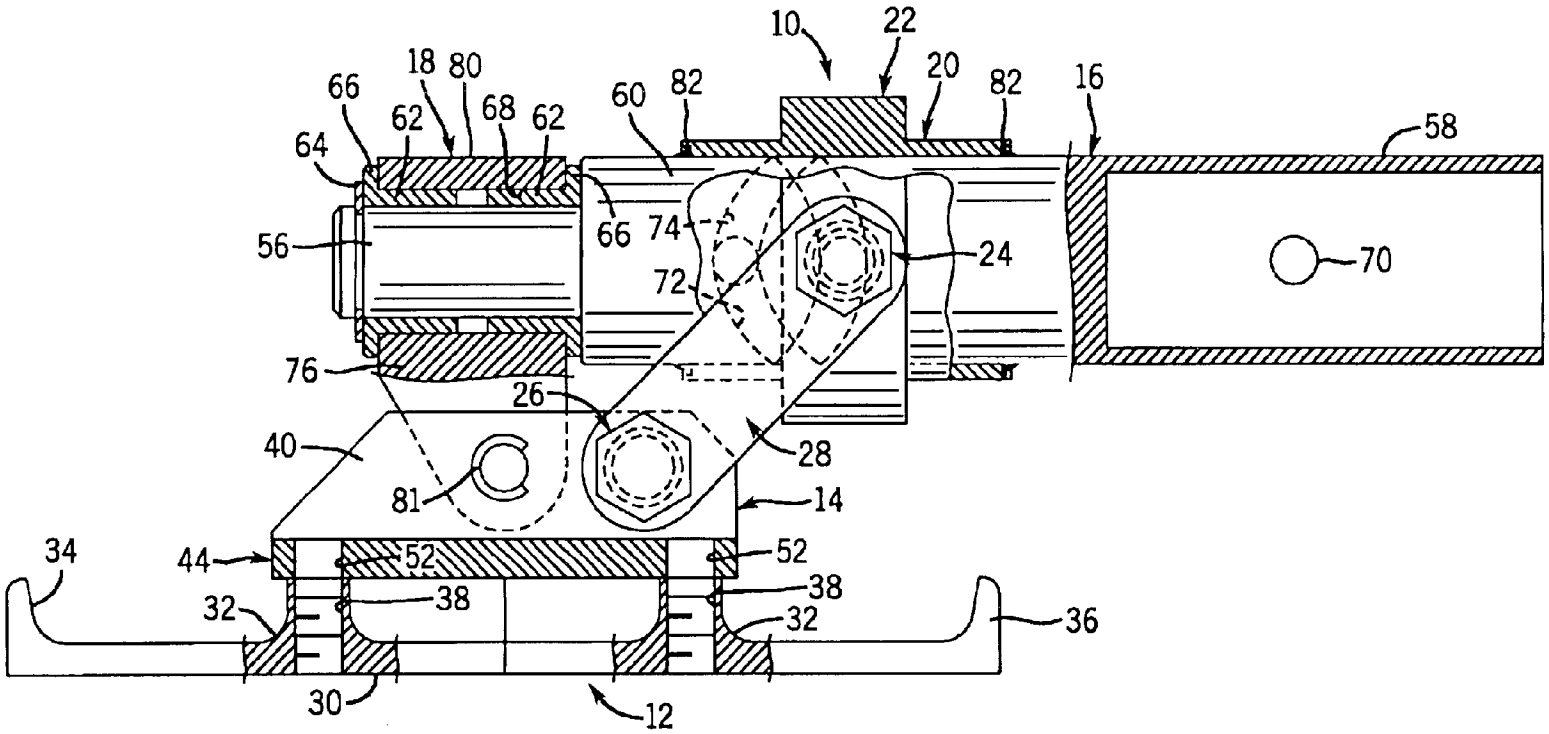
FIG. 1 is a side elevational view, in partial cross section, of the concrete float adjusting device of the present invention with the base support plate and float tilted a maximum distance in one direction.
Figure 2:
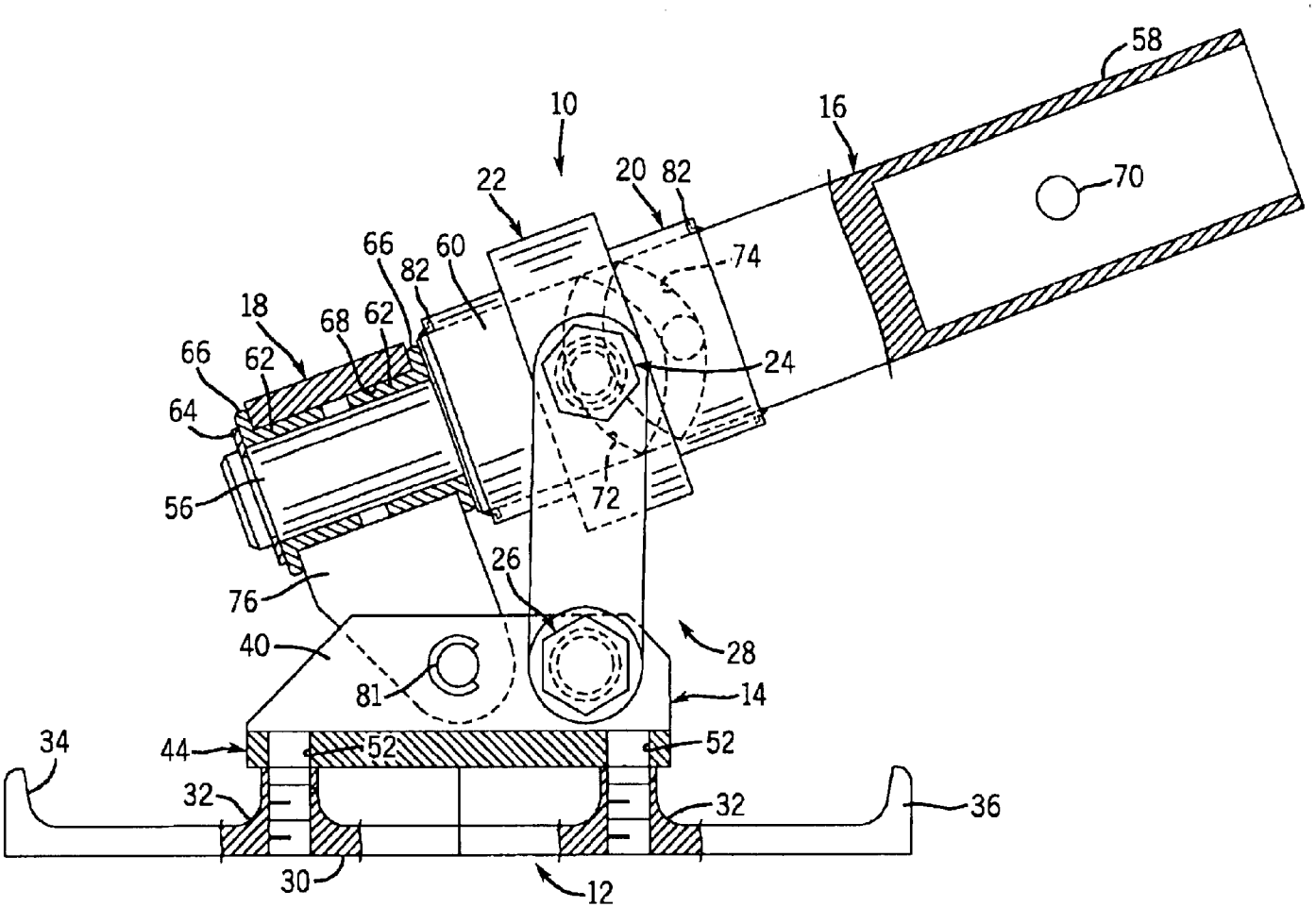
FIG. 2 is a view similar to FIG. 1 with the base support plate and float tilted a maximum distance in the opposite direction of FIG. 1.

Referring now to the drawings, FIGS. 1 and 2 illustrate a concrete float adjusting device 10 which is coupled to a float 12. The float adjusting device 10 is comprised of a base 14, an elongate shaft 16, a pivot bearing 18, a cylindrical protective sleeve 20 integral with a polygonal follower sleeve 22, a pair of upper pivot shafts 24, a pair of lower pivot shafts 26 and a pair of link arms 28.

The float 12 includes a surfacing face 30, a pair of central longitudinal ribs 32, a front longitudinal rib 34, and a rear longitudinal rib 36. The central ribs 32 are formed with rib mounting threaded holes 38 (FIG. 1). In use, the surfacing face 30 engages a wet concrete surface to create the desired surface texture or gradient. The ribs 32, 34, 36 are provided to improve the structural strength of the float 12, and provide an attachment surface for the float adjusting device 10.

Figure 3:
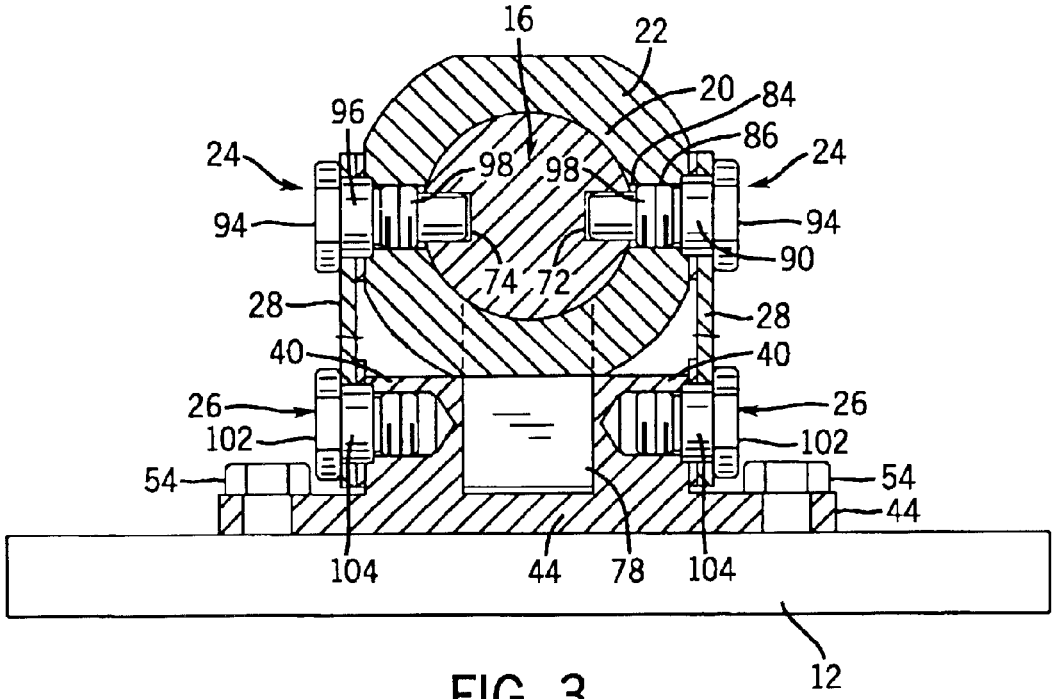
FIG. 3 is a partial cross sectional view of the concrete float adjusting device.
Figure 4C:
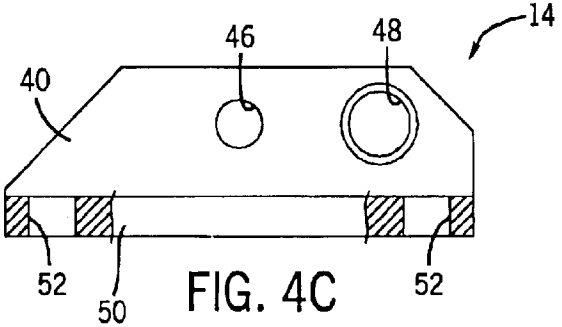
FIGS. 4A–4C are respective plan, end and side elevational views of the base.
Figure 4B:
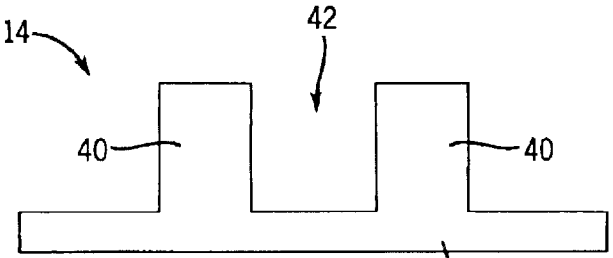
Figure 4A:
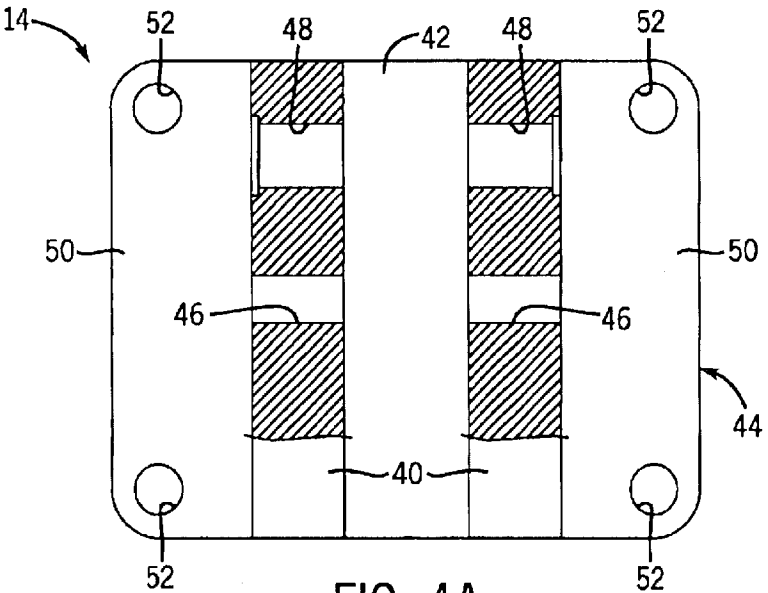

As best seen in FIGS. 4A–4C, the base 14 includes a pair of upstanding portions 40 spaced apart by a void 42 and integrally joined to a planar support plate 44 which overlies the central ribs 32. The upstanding portions 40 are formed with recesses 46 in a central portion and threaded bores 48 in a rear portion. The planar support plate 44 has laterally extending feet 50 which are formed with apertures 52 at the outer corners thereof. The apertures 52 are aligned with threaded holes 38 on the central ribs 32 and a set of four threaded bolts 54 (two being seen in FIG. 3) are passed through the apertures 52 and threaded into the holes 38 to facilitate attachment of the float 12 to the adjusting device 10.

Figure 5:
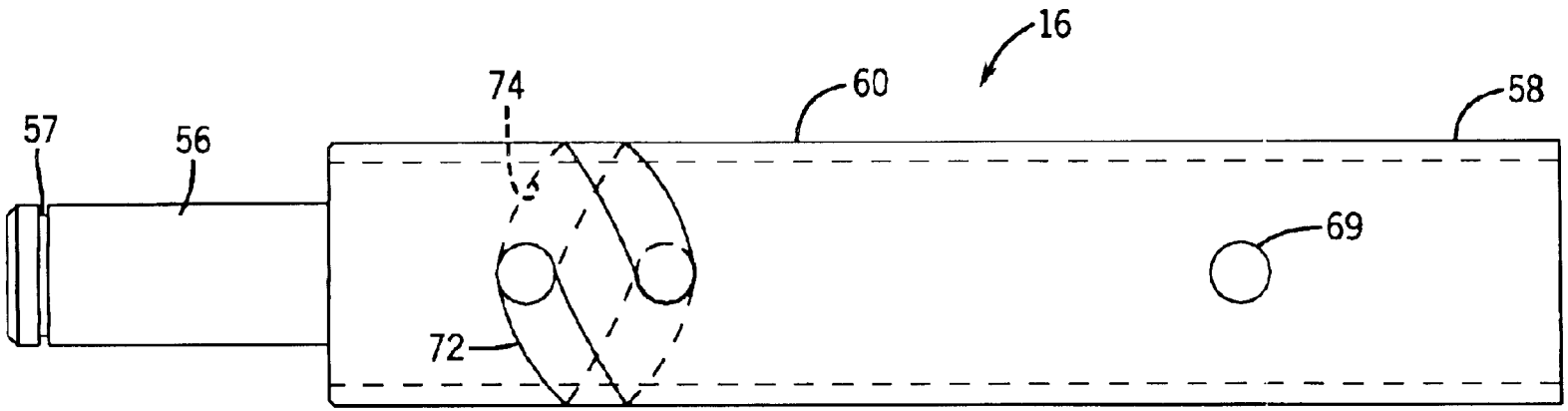
FIG. 5 is a side elevational view of the shaft.
Figure 6A:
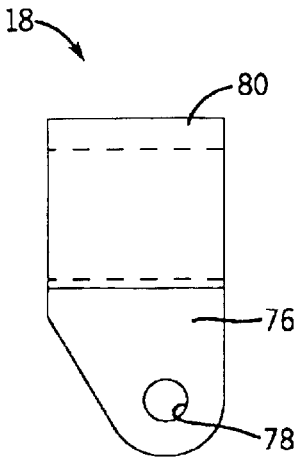
FIGS. 6A and 6B are respective side elevational and end views oaf the pivot bearing.
Figure 6B:
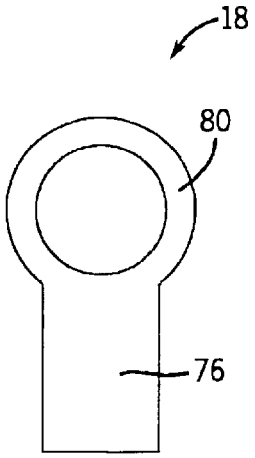

Referring to FIG. 5, the elongate shaft 16 is cylindrical and includes a narrow, solid front end portion 56 having 31 a circular groove 57 formed there in a hollow, tubular, handle-receiving rear end portion 58 and a solid intermediate portion 60. The narrow front end portion 56 is supported by a set of bearings 62 (FIGS. 1 and 2) which are held in place against an end surface of the intermediate portion 60 by a lock washer 64 disposed in the groove 57. The bearings 62 have front and rear radially extending walls 66 which define a recessed area 68 (FIGS. 1 and 2) therebetween. The rear end portion 58 and the intermediate portion 60 have identical outer diameters which are larger than the outer diameter of the front end portion 56. The rear end portion 58 is provided with holes 69 for receiving a pair of oppositely disposed, spring biased detents (one being shown at 70 in FIGS. 1 and 2) which enable at least one handle and, typically several handle extensions, (not shown) to be removably coupled to the shaft 16. The solid intermediate portion 60 is formed with a pair of spiral slots or 180° helical grooves, one slot 72 extending generally along one half of the intermediate portion 60 and the other slot 74 extending generally along the other half.

The pivot bearing 18, shown in FIGS. 1–3, 6A and 6B, includes a solid lower end 76 formed with a throughhole 78 and integrally connected with an upper end 80 configured as a tubular sleeve. A lower end 76 is received in the void 42 between the upstanding portions 40 of the base 14 such that the throughhole 78 and the recesses 46 in the base 14 are aligned. A cross pin 81 is inserted through the aligned throughhole 78 and recesses 46, and enables the lower end 76 of the pivot bearing 18 to be pivotally coupled to the base 14. The upper end 80 encircles the recessed area 68 of the bearings 62 and the narrow front end portion 56 of the shaft so as to rotatably mount the shaft 16 relative to the pivot bearing 18.

Figure 7A:
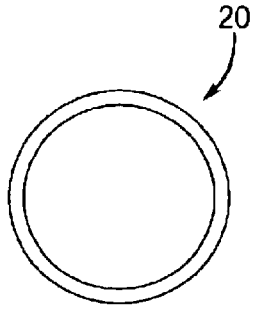
FIGS. 7A and 7B are respective end and cross sectional views of the protective sleeve.
Figure 7B:
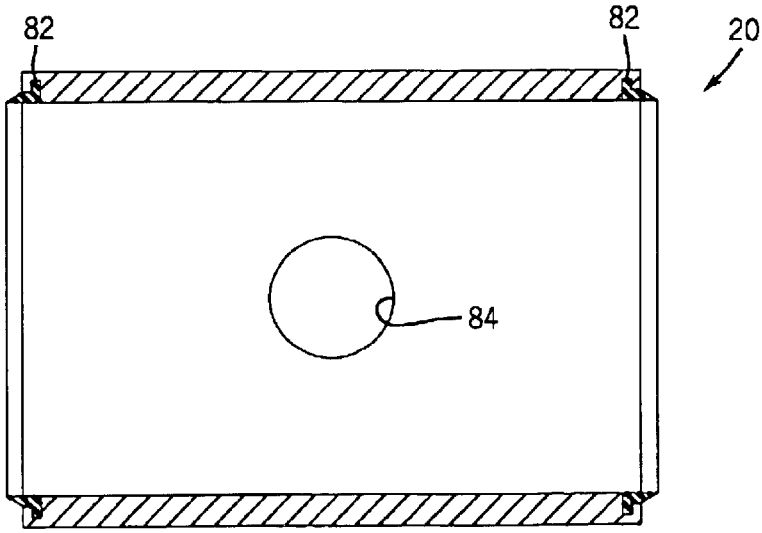

The protective sleeve 20 illustrated in FIGS. 7A and 7B slides upon and surrounds the intermediate portion 60 of the shaft 16 and, in particular, the spiral slots 72, 74 formed therein. It is the purpose of the protective sleeve 20 to prevent concrete and other debris from coming lodged in the spiral slots 72, 74 where the concrete can harden and negatively affect the concrete finishing operation as the float adjusting device 10 becomes jammed and requires a higher degree of maintenance. As seen in FIGS. 1, 2, 7A and 7B, the opposite ends of the protective sleeve 20 are provided with circular seals 82 to keep out moisture, dirt et cetera as the protective sleeve 20 slides on shaft 16. As will be appreciated hereafter, the protective sleeve 20 is designed with a pair of central orifices 84 which facilitate coupling to the follower sleeve 22.

Figure 8A:
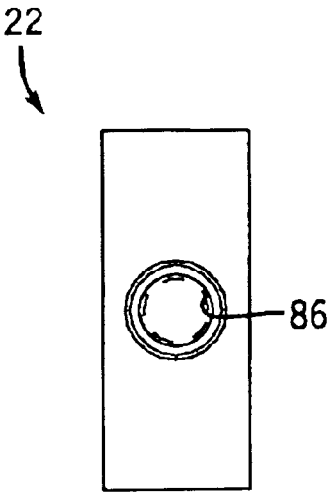
FIGS. 8A and 8B are respective side elevational and front views of the follower sleeve.
Figure 8B:
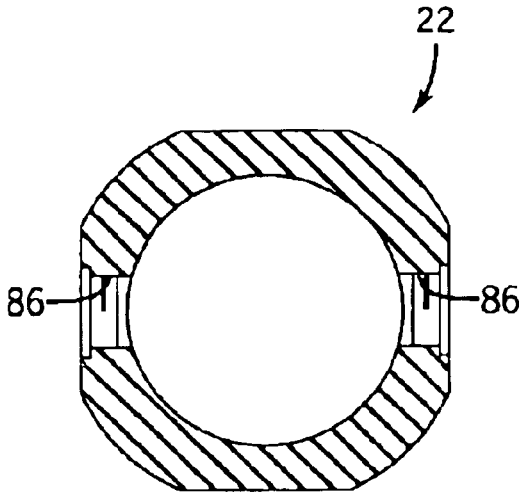

The follower sleeve 22 seen in FIGS. 8A and 8B is formed integral with the protective sleeve 20 and extends completely around the protective sleeve 20 and the intermediate portion 60 of the shaft 16. The follower sleeve 22 has a pair of countersunk openings 86 which are aligned with the orifices 84 of the protective sleeve 20 (as appreciated in FIG. 3).

Figure 9:
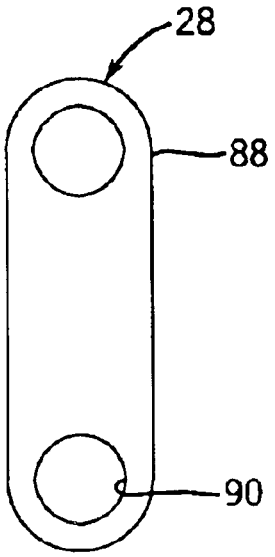
FIG. 9 is an elevational view of one of the link arms.

The pair of identical, shiftable link arms 28 is provided on opposite sides of the adjusting device 10. As seen in FIGS. 1, 2 and 9, each link arm 28 has an upper end with a hole 88 aligned with one of the openings 86 in follower sleeve 22, and a lower end with a hole 90 aligned with one of the bores 48 in base 14 FIG. 3 shows the pair of upper pivot shafts 24 having hex heads 94 and stepped portions 96 around which the upper ends of the link arms 28 are disposed. Each upper pivot shaft 24 has an inner end 98 which extends through one of the follower sleeve openings 86 and one of the protective sleeve orifices 84 and projects into one of the spiral slots 72 or 74 in shaft 16. FIG. 3 further shows the pair of lower pivot shafts 26 having hex heads 102 and stepped portions 104 around which the lower ends of link arms 28 are engaged. Each lower pivot shaft 26 extends through one of the link arm lower holes 90 and one of the base bores 48 and is threaded therein.

In use, this invention is used to manually change the angle of incidence of the float 12 relative to the shaft 16 depending on whether the float 12 is being pulled towards the user or pushed away from the user. The user holds the float 12 in position by means, for example, of a sectionalized handle attached to the rear end portion 58 of the shaft 16. By manually twisting the rear end portion 58, the shaft 16 is rotated clockwise or counterclockwise in the pivot bearing 18. Rotation of the shaft 16 and slots 72, 74 formed therein causes the follower sleeve 22 and the protective sleeve 20 to slide linearly along the intermediate portion 60 of the shaft 16 as the inner ends 98 of the upper pivot shafts 24 follow the path of the spiral slots 72, 74. This linear motion results in transmitting movement of the follower sleeve 22 and protective sleeve 20 to the base 14 through the shifting movement of the link arms 28. Because of the pivotal connection between the base 14 and the pivot bearing 18, the base 14 and float 12 connected thereto will tilt relative to the shaft 16. When the user is pushing float 12 forward as shown by the arrow in FIG. 2, the leading edge of the float 12 is tipped upward when the shaft is rotated fully clockwise. When the user pulls the float 12 backwards as seen by the arrow in FIG. 1, the back edge of the float 12 may be inclined by rotating the shaft 16 fully counterclockwise.

Various alternatives and embodiments are contemplated as being within the scope of the following claims particularly pointing out and distinctly claiming the subject matter regarded as the invention.

I claim:

1. A concrete float adjusting device adapted to be connected to a concrete float, the device comprising:

a base having a pair of spaced apart upstanding portions and a planar support plate adapted to be attached to the concrete float;

an elongated, rotatable, cylindrical shaft having a rear end portion of a first diameter adapted to receive a handle therein, an intermediate portion of the first diameter formed with a pair of spiral slots therein and a front end portion having a second diameter less than that of the first diameter, one of the spiral slots extending along one half the first diameter of the intermediate portion and the other of the spiral slots extending over the other half of the first diameter of the intermediate portion;

a pivot bearing having a lower end pivotally mounted to the base, and an upper end encircling the front end portion of the shaft such that the shaft is rotatably received in the upper end of the pivot bearing;

a protective sleeve surrounding the intermediate portion of the shaft for, slidable movement thereon and protectively covering the spiral slots to prevent accumulation of material therein, the protective sleeve being provided with a pair of circular seals at opposite ends thereof, the seals being engageable with the intermediate portion of the shaft;

a follower sleeve extending completely around the protective sleeve and the intermediate portion of the shaft, the follower sleeve being integrally coupled to the protective sleeve such that the follower sleeve and the protective sleeve are slidable as a unit along the intermediate portion of the shaft;

a pair of upper pivot shafts projecting through the protective sleeve and the follower sleeve, the upper pivot shafts having outer ends located on opposite sides of the follower sleeve, and inner ends engaged against walls forming the spiral slots;

a pair of lower pivot shafts having outer ends located on opposite sides of he upstanding portions of the base, and inner ends projecting into the upstanding portions of the base; and a pair of shiftable link arms, each having an upper end pivotally connected to one of the upper pivot shafts, and a lower end pivotally connected to one of the lower pivot shafts, whereby rotation of the shaft causes the follower sleeve and the protective sleeve to move in a motion linearly along the intermediate portion of the shaft as the inner ends of the upper pivot shafts follow a path of the spiral slots, the linear motion being transmitted via shifting of the link arms to the base which is pivotally coupled to the pivot bearing so as to change the angular relationship between the shaft and the float adapted to be connected to the base.

2. The concrete float adjusting device of claim 1, wherein the base includes feet extending laterally from the upstanding portions.

3. The concrete float adjusting device of claim 1, wherein a set of bearings lie between the front end portion of the shaft and the upper end of the pivot bearing.

4. The concrete float adjusting device of claim 3, wherein the bearings have radially extending walls engaging opposite ends of the upper end of the pivot bearing.

5. The concrete float adjusting device of claim 4, wherein one of the radially extending walls engages a lock washer disposed on the front end portion of the shaft, and another of the radially extending walls engages the intermediate portion of the shaft.

6. The concrete float adjusting device of claim 1, wherein the lower end of the pivot bearing is pivotally received between the upstanding portions of the base.

7. The concrete float adjusting device of claim 1, wherein the rear end of the shaft is provided with spring biased detent structure adapted to mount the handle thereon.

8. The concrete float adjusting device of claim 1, wherein a first horizontal pivot axis is defined by the pivotal mounting of the lower end of the pivot bearing to the upstanding portions of the base.

9. The concrete float adjusting device of claim 1, wherein a second horizontal pivot axis defined by the lower pivot shafts.

10. The concrete float adjusting device of claim 1, wherein a third horizontal pivot axis is defined by the upper pivot shafts.

* * * * *